United States Patent [19]

Berry et al.

[11] 4,113,139

[45] Sep. 12, 1978

[54] SEALED TAPED BAGS AND SEALED TAPE BAG DISPENSER

[75] Inventors: Lawrence James Berry, Amarillo, Tex.; Stanley Darwin Hall, Taylors, S.C.

[73] Assignee: W. R. Grace & Co., Duncan, S.C.

[21] Appl. No.: 796,279

[22] Filed: May 12, 1977

[51] Int. Cl.[2] ..... B65D 75/42

[52] U.S. Cl. ..... 221/1; 221/71

[58] Field of Search ..... 221/70–74, 221/210, 217, 218; 206/460, 554, 813; 198/423; 229/69

[56] References Cited

U.S. PATENT DOCUMENTS

| | | | |
|---|---|---|---|
| 3,587,843 | 6/1971 | Wing | 206/460 |
| 3,952,871 | 4/1976 | Erickson | 229/69 X |
| 3,987,931 | 10/1976 | Fell et al. | 229/69 X |

*Primary Examiner*—Stanley H. Tollberg

*Attorney, Agent, or Firm*—John J. Toney; William D. Lee, Jr.; John B. Hardaway

[57] ABSTRACT

A chain of imbricated bags connected and supported by a carrier removably secured to the closed end of each of the bags is used for individually dispensing the leading bag when the carrier is moved in a direction which advances the sealed end of the bag ahead of the open end. A method and apparatus for dispensing such bags are also included.

5 Claims, 5 Drawing Figures

FIG. 1
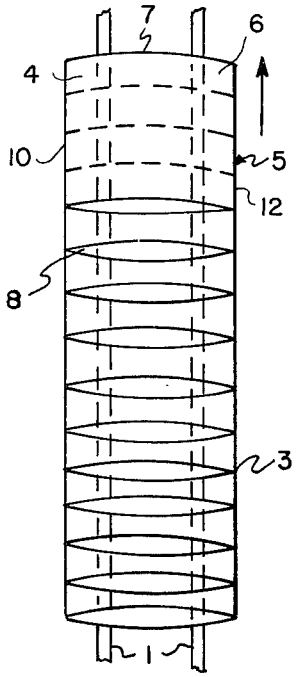
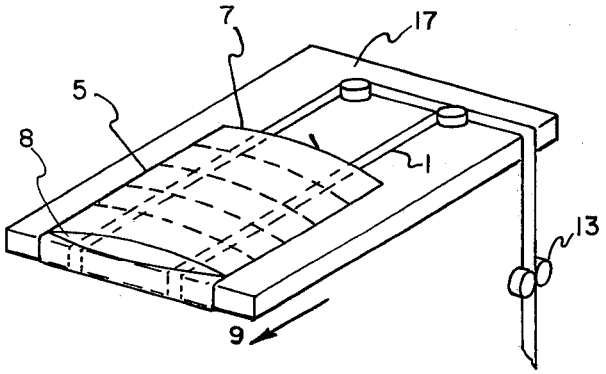
FIG. 2
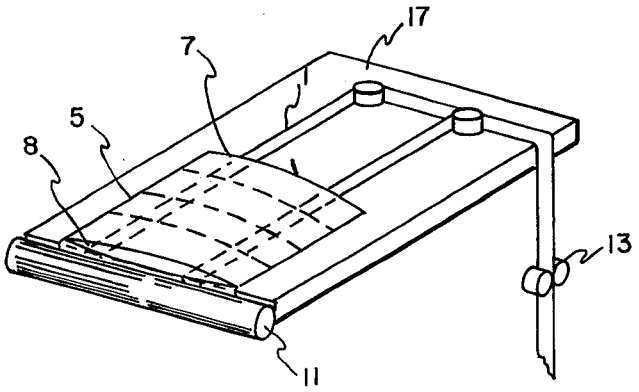
FIG. 3

SEALED TAPED BAGS AND SEALED TAPE BAG DISPENSER

BACKGROUND OF THE INVENTION

This invention relates generally to the art of dispensing individual flexible plastic containers and more particularly to a technique for dispensing such containers when they are attached in an imbricated manner to a carrier strip.

Various techniques for dispensing flexible containers or bags utilizing a carrier strip have been devised. One such technique is described in U.S. Pat. No. 3,161,347 to Hannon. The technique disclosed therein comprises attaching the open end of a container to a carrier strip which advances the chain of bags in a desired fashion. Each of the bags are disposed along the chain in an imbricated manner such that each bag opening is covered by the bag which immediately precedes it. The carriers disclosed therein may take the form of a strip having substrips of adhesive thereon. The system is arranged to operate in a manner such that the open end of the lead bag leads the advance of the overall chain. In this manner forced air may be utilized to open the lead bag to permit the grasping of a portion of the opened bag and facilitate the insertion of an object into the bag.

Another technique for dispesning imbricated bags as disclosed in U.S. Pat. No. 3,587,843 to Wing. The invention disclosed therein is a chain of imbricated bags connected together and supported by two strands of tape. The bags each have two overlying sides, one of the sides being secured to both of the tapes. The open end of the bags are oriented in the same direction with each bag offset along the tape and overlying the opening of the underlying bag. It is an object of the invention disclosed therein to provide a package of bags that will inflate to a square type opening when the lead bag is impinged upon by a stream of fluid.

While these prior art techniques are perfectly satisfactory for many applications, it is desirable to provide alternative techniques for dispensing flexible containers for use in a packaging operation.

SUMMARY OF THE INVENTION

It is thus an object of this invention to provide a novel chain of imbricated bags.

It is a further object of this invention to provide a novel chain of imbricated bags which permits the bags to be removed in a dispensing mode while maintaining the carrier in a state of tension.

It is still a further object of this invention to provide a novel method for dispensing imbricated bags.

It is a still further object of this invention to provide a novel apparatus for dispensing imbricated bags.

These as well as other objects are accomplished by utilizing a carrier removably secured to a series of imbricated bags attached to the carrier by the sealed end and with the open end of the bag being unattached to the carrier. The bags are dispensed by moving the carrier in a first direction to dispose the leading bag in a dispensing position. The lead bag is removed from the carrier by moving it along a path which is substantially oppositely opposed to the first direction. The carrier is further advanced in the first direction to dispose a second and subsequent bags in the dispensing position. The apparatus for dispensing the imbricated bags in accordance with this invention comprises a means for advancing the carrier in the first direction and a means for detecting the presence or absence of a bag in the dispensing position. The detecting means is effective to deactivate the advancing means when the dispensing position is occupied and to activate the advancing means when the dispensing position is vacant.

BRIEF DESCRIPTION OF THE DRAWINGS

FIG. 1 is a plan view of a chain of imbricated bags in accordance with this invention.

FIG. 2 is an isometric drawing of a bag in the dispensing position in accordance with the process of this invention.

FIG. 3 illustrates a modification of the embodiment shown in FIG. 2.

DETAILED DESCRIPTION

Figure 4:
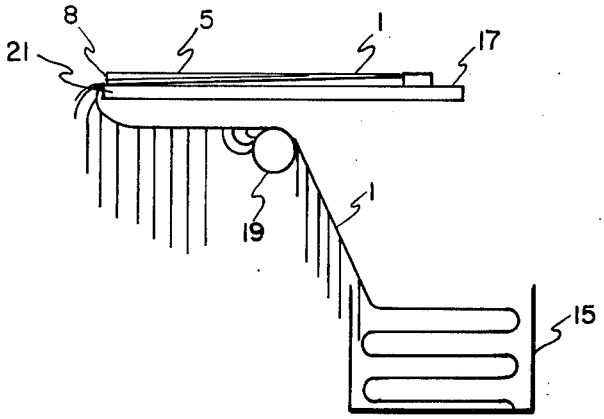
FIG. 4 schematically illustrates an apparatus for use in accordance with this invention.

In accordance with this invention, a novel product embodying a chain of imbricated bags useful for dispensing in a continuous packaging process has been developed. The novel chain of imbricated bags are useful in the method of this invention wherein the imbricated bags are continuously dispensed in such a packaging operation. An apparatus is provided in accordance with this invention which embodies the method of dispensing imbricated bags.

Prior art techniques of dispensing containers or bags are primarily designed for situations involving manual handling of the articles to be packaged with emphasis upon automated bag movement. With the advent, however, of automatic bag loading equipment wherein the articles to be handled are effectively within the domain of automatic machinery and the bags are manually positioned for the functioning of the bag loading equipment, conventional bag dispensing means proved less than totally satisfactory for such equipment. Such automatic bag loading apparatuses are disclosed, for example, in copending U.S. application Ser. No. 718,259 filed Aug. 27, 1976, and U.S. Pat. No. 3,942,624. The use of such bag loading equipment makes it necessary for bags to be readily at hand and dispensed in a matter such that they are easily opened in order to meet the bag loading equipment in a time which coincides with the unloading time of the bag loading equipment.

Thus in accordance with this invention it has been found that a chain of imbricated bags having the sealed end of the bag attached to the chain satisfies the need for an article from which such bags can be individually dispensed. By utilizing a carrier which is movable in a direction opposite to the direction from which the bags are removed the carrier is placed in a state of tension during the step of bag removal. An additional advantage of such a technique is that the supply of bags as well as the discarded carrier are located in a position which is remote from the operator. The advantage of such remoteness is that the operator is not hampered by the presence of packaging and auxiliary equipment during the packaging process. Further advantages will be apparent from the following particularized description with reference to the accompanying figures of drawing.

FIG. 1 of the drawing illustrates a chain of imbricated bags in accordance with this invention. Preferably the chain comprises a carrier in the form of a pair of tapes 1. The tapes are attached to one side of a plurality of bags 3. The leading bag 5 has a sealed end 7 and an open end 8. The open ends of the bags are shown as loops 8 for purposes of illustration. In actuality the open end would have one side of the bag substantially coextensive with the opposite side of the bag such that the generally elliptical appearance of the opening 8 would not exist. However, bags having sides which do not have a coterminous opening may be utilized with the chain of imbricated bags in accordance with this invention, so as to produce an opening having the elliptical configuration shown in the drawings.

The characteristics of the tape carrier may in general be the same as those characteristics described in U.S. Pat. No. 3,587,845 which is herewith incorporated by reference. Optionally, however, the carrier may take the form of a strip as is described in U.S. Pat. No. 3,161,347 which is also herewith incorporated by reference.

The functioning of the chain of imbricated bags as a means of dispensing is best understood by reference to FIG. 2 of the drawings. As is shown in FIG. 2 of the drawings the leading bag 5 is shown in its dispensing position such that the bag is removed by grasping near the opening 8 and pulling in the direction illustrated by arrow 9 such that the bag is removed in a direction substantially oppositely opposed to the direction of movement of carrier 1. It is readily understood that by having the carrier move in one direction and the removal force being applied in an oppositely disposed direction the carrier remains in a tensioned state during the dispensing operation.

For purposes of description each bag like leading bag 5 in FIG. 1 has generally planar sides 4 and 6 and substantially linear edges 10 and 12 connecting the open end 8 with closed end 7. The carrier 1 runs in substantially the same direction as edges 10 and 12.

An alternative embodiment is shown in FIG. 3 of the drawings wherein the embodiment of FIG. 2 is provided with a roller 11 so as to grasp the open end of the bag during the removal step. By the use of roller 11, the open end 8 is trapped beneath the roller while the closed end 7 is attached to the carrier 1. By grasping the visible surface of the lead bag 5 and gently applying a force in the dispensing direction, a single side of the bag is grasped such that the bag may be readily opened upon removal from the dispensing means. As is shown in FIGS. 2 and 3, the carrier is advanced by rollers or other appropriate advancing means 13. The overall operation of the process in accordance with this invention can best be understood from referring to FIG. 4 of the drawings. As is shown therein the carriers 1 are advanced by advancing means 13 from a source of supply 15 in a first direction to meet a dispensing top 17 across a roller 19 for maintaining a chain in a proper orientation across the end 21 of dispensing surface 17. The end 21 is a pivot point about which the direction of travel of the carrier changes substantially 180°. It will be noted that the opened end 8 of the lead bag 5 is substantially coincidental with the pivot point 21 when it is in its dispensing position. It is apparent that upon removal of bag 5 the carrier can be advanced in a direction opposite to the removal direction so as to place the next following bag in the dispensing position. A particular advantageous feature of this arrangement is that upon removal of the lead bag 5, the carrier 1 remains in a tensioned state. The removal of the lead bag tends to have a smoothing effect upon the bag which immediately follows it and underlies so as to render that following bag more suitable for dispensing when in the dispensing position.

Figure 5:
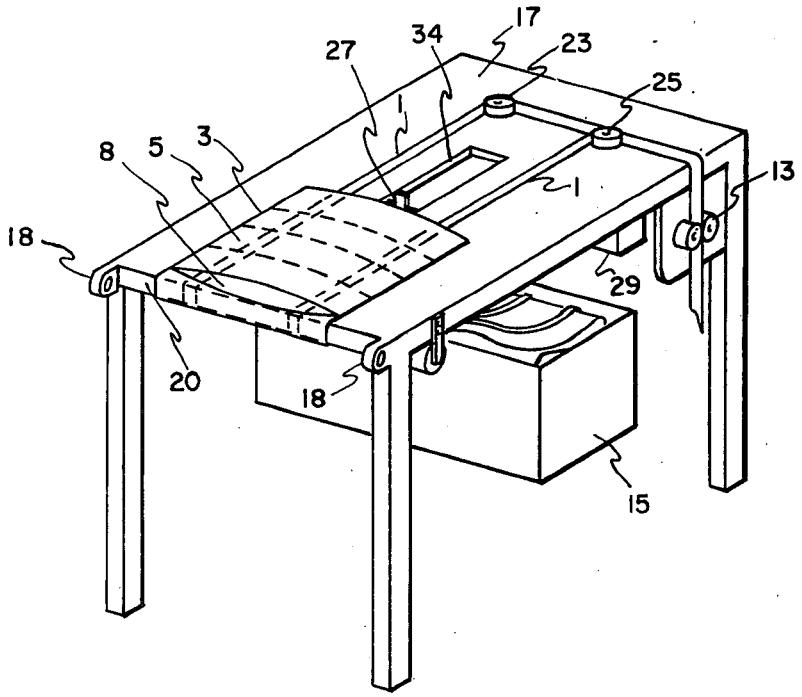
FIG. 5 illustrates a more complete illustration of the apparatus utilized in accordance with this invention.

The apparatus utilized in carrying out the dispensing method of this invention which utilizes the chain of imbricated bags of this invention is more fully illustrated in FIG. 5 of the drawings. As is shown therein a flat dispensing surface 17 is utilized to support the chain of bags 3 when the lead bag is in the dispensing mode. The surface 17 is integrally associated with means 18 for mounting roller 11 (not shown in this view) for pinching the open end of the lead bag against edge 20 of surface 17. The means for advancing 13 advances the carrier 1 across idler rolls 23 and 25 so as to advance the bags in a direction which is substantially oppositely opposed to the dispensing direction. The apparatus is in its preferred mode provided with a sensing means 27 in the form of a spring loaded switch such that the advance of the imbricated bags depresses the spring loaded switch so as to deactivate the advancing means 13. Such deactivation may take place through well-known control means such as 29 in the form of a control box. Such controls may be either pneumatic or electric as are well known to those skilled in the art. Upon removal of the lead bag 5 the switch 27 is no longer depressed but springs forward such that the control means 29 again activates the advancing means until the following bag again contacts switch 27 to depress the same and deactivate the advancing means 13. The switch 27 is preferably adjustably located on support surface 17 such as by means of slot 31 so as to allow for the dispensing of various sized bags.

With the above description of the apparatus of this invention in mind, it is readily apparent that such apparatus may be modified to provide for more than one dispensing surface. Such an apparatus may have dispensing surfaces disposed one above the other and/or side by side. With such an arrangement, an operator is able to have a display of various size bags within easy grasp so as to be able to choose an appropriately sized bag for the article being packaged.

It is thus seen that the chain of imbricated bags, the method for dispensing such bags and the apparatus used in carrying out such method provide a novel and highly useful technique for dispensing bags for use in a continuous packaging process. It is seen that the operator is located to the front of the dispensing surface 17 such that the front or open part of lead bag 8 is grasped by the operator to readily facilitate the opening thereof for the insertion of an article. While this disclosure has used the term "bag" to refer to flexible containers which are dispensed by the chain of imbricated bags it is readily apparent that containers of similar structure such as pouches and casings. The term "bag" is thus used broadly to include any type of flexible container or recepticle.

From viewing FIG. 1 of the drawings which illustrates a chain of imbricated bags in accordance with this invention, it is readily apparent that various parameters go into the construction of such a chain. Such parameters, however, are not critical. For example, the spacing between bags needs only be sufficient for the bag to have sufficient area attached to the tape to provide for a release when a force of about 2 pounds is applied to the bag at an angle of 30° from the plane of the carrier. It is readily apparent that the same force of 2 pounds may be utilized to calculate the tack and necessary tape area. For example, utilizing bags which are approximately 12 inches by 12 inches may be readily dispensed when attached to a pair of tapes at intervals of 1 to 1 and ½ inches. Generally the tape may be on the order of ¼ inch across to provide sufficient tack to maintain the integrity of the chain during dispensing and yet permit easy removal of the bag during the actual step of dispensing. The adhesives are generally spaced apart on the imbricated bag about ¼ of the width of the bag in from each side within a tolerance of about ⅛ of the width of the bag. Such parameters, however, are preferred and are not critical to carrying out the dispensing technique of this invention.

It is thus seen that the chain of imbricated bags, the technique for dispensing such bags and the apparatus utilized therein, provide a novel solution to the problem of dispensing bags for use in a continuous packaging operation, particularly when an automatic bag loader is utilized. The description as given above of the preferred embodiments thereof is not to be construed as limiting in nature. This invention is thus to be limited only by the scope of the following appended claims.

What is claimed is:

1. A method for dispensing flexible bags from a chain of imbricated bags, said bags being removably secured to a carrier, comprising the steps of:

moving said carrier in a first direction to dispose the leading bag of said chain of imbricated bags in a dispensing position, said bags having a closed end and an open end, said open and closed ends being connected by generally planar bag sides and substantially linear bag edges when said bags are in a flattened state, one of said sides adjacent said closed end being secured to said carrier, said carrier running substantially in the same direction as said edges, and said closed end preceding said open end in said first direction;

removing said lead bag from said chain along a path substantially oppositely opposed to said first direction; and advancing said carrier along said first direction to dispose a second bag in said dispensing position.

2. The method according to claim 1 comprising, prior to said step of moving, the further step of advancing said carrier in a direction substantially oppositely opposed to said first direction to a point at which said direction of advance is changed to said first direction by pivoting said carrier about a point, said open end of said bag in said dispensing position being substantially coincidental with said point.

3. The method according to claim 1 wherein said carrier comprises at least two parallel strands of tape and said bags are secured to said tape by an adhesive.

4. The method according to claim 2, including the further step of:

detecting the position of a bag in the dispensing position and discontinuing said advance until said bag is removed from said dispensing position;

detecting the removal of said bag from said dispensing position; and further advancing said carrier until the next succeeding bag is in said dispensing position.

5. An apparatus for dispensing flexible bags said flexible bags being attached in an imbricated fashion to a carrier, said bags having an open end and a closed end, said closed end being attached to said carrier, said apparatus comprising; p1 a dispensing surface;

means for advancing said carrier in a first direction across said dispensing surface;

means for detecting the presence or absence of a container in a dispensing position on said dispensing surface;

control means for deactivating said means for advancing when said dispensing position is occupied and for activating advancing means when said dispensing position is vacant; and a roller to pinch the open end of the container in the dispensing position against an edge of said dispensing surface.

* * * * *

UNITED STATES PATENT OFFICE

CERTIFICATE OF CORRECTION

Patent No. 4,113,139 Dated September 12, 1978

Inventor(s) Lawrence James and Stanley Darwin Hall

It is certified that error appears in the above-identified patent and that said Letters Patent are hereby corrected as shown below:

Claim 5, line 5, delete "pl"

Signed and Sealed this

*Sixth* Day of *March 1979*

[SEAL]

*Attest:*

RUTH C. MASON
*Attesting Officer*

DONALD W. BANNER
*Commissioner of Patents and Trademarks*